United States Patent [19]

Mine

[11] Patent Number: 4,569,386

[45] Date of Patent: Feb. 11, 1986

[54] METHOD OF MANUFACTURING A CYLINDRICAL BILLET

[75] Inventor: Hisanobu Mine, Kobe, Japan

[73] Assignee: Kabushiki Kaisha Kobe Seiko Sho, Kobe, Japan

[21] Appl. No.: 552,029

[22] Filed: Nov. 15, 1983

[51] Int. Cl.[4] ..... B22D 11/12

[52] U.S. Cl. ..... 164/476; 164/465; 164/417; 29/33 C; 29/33 D; 228/145; 72/49; 148/2

[58] Field of Search ..... 164/476, 477, 464, 465, 164/417, 421; 148/2; 29/33 D, 33 C; 72/49; 228/176, 145

[56] References Cited

U.S. PATENT DOCUMENTS

| | | | |
|---|---|---|---|
| 3,483,915 | 12/1969 | Schneckenberger | 164/417 |
| 3,961,741 | 6/1976 | Klein | 228/145 |
| 4,061,264 | 12/1977 | Bartels et al. | 228/145 |
| 4,082,211 | 4/1978 | Embury | 228/145 |
| 4,353,494 | 10/1982 | Olsson | 228/176 |
| 4,477,147 | 10/1984 | Winter et al. | 29/33 D |

FOREIGN PATENT DOCUMENTS

| | | | |
|---|---|---|---|
| 3034792A1 | 4/1982 | Fed. Rep. of Germany | 29/33 D |

*Primary Examiner*—Nicholas P. Godici
*Assistant Examiner*—K. F. Berg
*Attorney, Agent, or Firm*—Oblon, Fisher, Spivak, McClelland & Maier

[57] ABSTRACT

A method of manufacturing a cylindrical billet having a predetermined length useable as raw material for producing a pipe. This method is practiced by way of the steps of drawing a cast slab from a casting mold on a continuous casting stand, spirally winding or cylindrically bending it around a rotating mandrel, joining together both end faces of the wound or bent cast slab to a cylindrical body and cutting it to a predetermined length. Two or more cast slabs may be used for forming the cylindrical body. Two rectangular cast slabs may be used as starting material which are subjected to roll forming and thereafter are cut to the predetermined length. They are then press worked to form a recess having a semi-circular cross-sectional configuration whereby a cylindrical body is constituted by assembly thereof in a superimposed relation. Alternatively, a cylindrical body may be constituted by two cast slabs each of which is subjected to roll forming over both the outside and inside surfaces thereof, the outside surface being roll formed to the semi-circular cross-sectional configuration by means of a plurality of forming rollers while the inside surface is formed with a longitudinally extending recess having the semi-circular cross-sectional configuration via a plurality of grooving rollers. Two roll formed cast slabs are united together via a pair of concave drum shaped rollers.

9 Claims, 21 Drawing Figures

METHOD OF MANUFACTURING A CYLINDRICAL BILLET

BACKGROUND OF THE INVENTION

1. Field of the Invention

The present invention relates to a method of manufacturing a cylinderical billet and more particularly to a method of manufacturing a cylindrical billet having a predetermined length usable as starting material for producing a pipe.

2. Description of the Prior Art

To practice the conventional method of manufacturing a seamless steel pipe Mannesmann type plug mill, Mannesmann type assel mill or the like have been heretofore employed. In the conventional manufacturing facilities as mentioned above seamless steel pipes are typically produced by way of the steps of heating a solid billet having a round or square cross-sectional configuration, piercing it to form a cylindrical billet which is usable as starting material for making a required steel pipe and causing it to be subjected to diameter enlarging or thickness reduction rolling.

In order to assure that seamless steel pipes having a high quality are manufactured at a reduced cost a variety of technical research and development have long since been conducted with respect to each of the above-mentioned manufacturing steps. In practice, however, any remarkable improvement fails to be achieved in respect of saving of material and thermal energy, increased efficiency of operation and reduction of manufacturing cost.

SUMMARY OF THIS INVENTION

Hence, the present invention has been made with the foregoing background in mind and its object resides in providing a method of manufacturing a cylindrical billet which does not require the conventional steps of blooming, heating, piercing and diameter enlarging, each of which constitutes an essential part for the conventional manufacturing method.

A further object of the present invention is to provide a method of manufacturing a cylindrical billet which makes it possible to produce a large number of seamless steel pipes without any intermittence while a relatively small amount of thermal energy is consumed therefor.

Another object of the present invention is to provide a method of manufacturing a cylindrical billet which assures remarkable saving of material and thermal energy and production at a high operational efficiency.

To accomplish the above objects there is proposed according to the present invention a method of manufacturing a cylindrical billet consisting essentially of the steps of drawing a cast slab from a casting mold on a continuous casting stand, spirally winding or bending the same around a rotating mandrel with the aid of a plurality of guide rollers, joining together both the end faces of the wound or bent cast slab to a cylindrical body and cutting it to a predetermined length when it is displaced away from the free end of the mandrel by a certain distance.

Further, there is proposed according to a preferred embodiment of the present invention a method of manufacturing a cylindrical billet further including the steps of spirally winding the cast slab around the rotating mandrel while thrusting it toward the latter by means of the guide rollers, axially thrusting one side face of the cast slab by means of a pusher including a guide face which is inclined at a certain angle relative to the axis of the mandrel in order to assure that adjacent end faces of the cast slab come in contact with one another and joining together the adjacent end faces of the spirally wound cast slab.

Further, there is proposed according to another preferred embodiment of the present invention a method of manufacturing a cylindrical billet further including the steps of rolling the cast slab to enlarge it in width in the lateral direction, bending both the side parts of the flattened cast slab around the mandrel with the aid of two arrays of guide rollers so as to encase the mandrel with the cast slab in such a manner that a contact line between both the end faces of the cast slab extends in the direction of movement of the latter and joins together both end faces of the cylindrically bent cast slab in the form of a seamed pipe.

Further, there is proposed according to another embodiment of the present invention a method of manufacturing a cylindrical billet essentially comprising the steps of drawing a plurality of cast slabs from a plurality of casting molds on a continuous casting stand, each of said cast slabs having a cross-sectional configuration which corresponds to a fragment of the annular cross-sectional configuration of a required cylindrical billet divided by the number of cast slabs, bending each of the cast slabs around a rotating mandrel by means of a plurality of guide rollers until both end faces of the one cast slab comes in contact with those of the other cast slab in such a manner that a contact line between both end faces of the adjacent cast slabs extends in the direction of movement of the cast slabs, linearly joining together end faces of the adjacent bent cast slabs in a face-to-face relation and cutting the thus formed cylindrical body to a predetermined length when it is displaced away from the free end of the mandrel by a certain distance.

Further, there is proposed according to yet another embodiment of the present invention a method of manufacturing a cylindrical billet essentially comprising the steps of drawing a cast slab from a casting mold on a continuous casting stand, roll forming it to the semi-circular cross-sectional configuration while such has little resistance against deformation, cutting the roll formed cast slab to a predetermined length, press working the superimposed assembly of two roll formed cast slabs which are laid in a press working device with a mandrel interposed therebetween along the axis of a cylindrical configuration of the assembly, placing one semi-cylindrical cast slab on the other semi-cylindrical cast slab in the form of a cylindrical body and joining together the thus superimposed assembly of two semi-cylindrical cast slabs.

Further, there is proposed according to still another embodiment of the present invention a method of manufacturing a cylindrical billet essentially comprising the steps of drawing two cast slabs from two cast molds on a continuous casting stand, each of said cast slabs having a rectangular cross-sectional configuration, guiding the cast slabs forward with the aid of a plurality of forming rollers and a plurality of grooving rollers in such a manner as to cause them to be united together by means of a pair of uniting rollers, said forming rollers serving to gradually roll form the outside surface of each of the cast slabs to the semi-circular configuration while said grooving rollers serve to gradually form on the inside surface of each of the cast slabs a longitudinally extending recess having a semi-circular cross-sectional configuration, joining together the thus cylindrically united cast slabs to a cylindrical body in a face-to-face relation and cutting the thus formed cylindrical body to a predetermined length when it is displaced away from the pair of uniting rollers by a certain distance.

Other objects, features and advantages of the present invention will become apparent from reading of the following description made in conjunction with several preferred embodiments thereof with reference to the accompanying drawings.

BRIEF DESCRIPTION OF THE DRAWINGS

The accompanying drawings will be briefly described below.

DETAILED DESCRIPTION OF THE PREFERRED EMBODIMENTS

Now, the present invention will be described in a greater detail hereinbelow with reference to the accompanying drawings which schematically illustrate preferred embodiments of the invention.

First, description will be made below as to a method of manufacturing a cylindrical billet in accordance with the first embodiment of the invention with reference to FIGS. 1 to 5.

Figure 1:
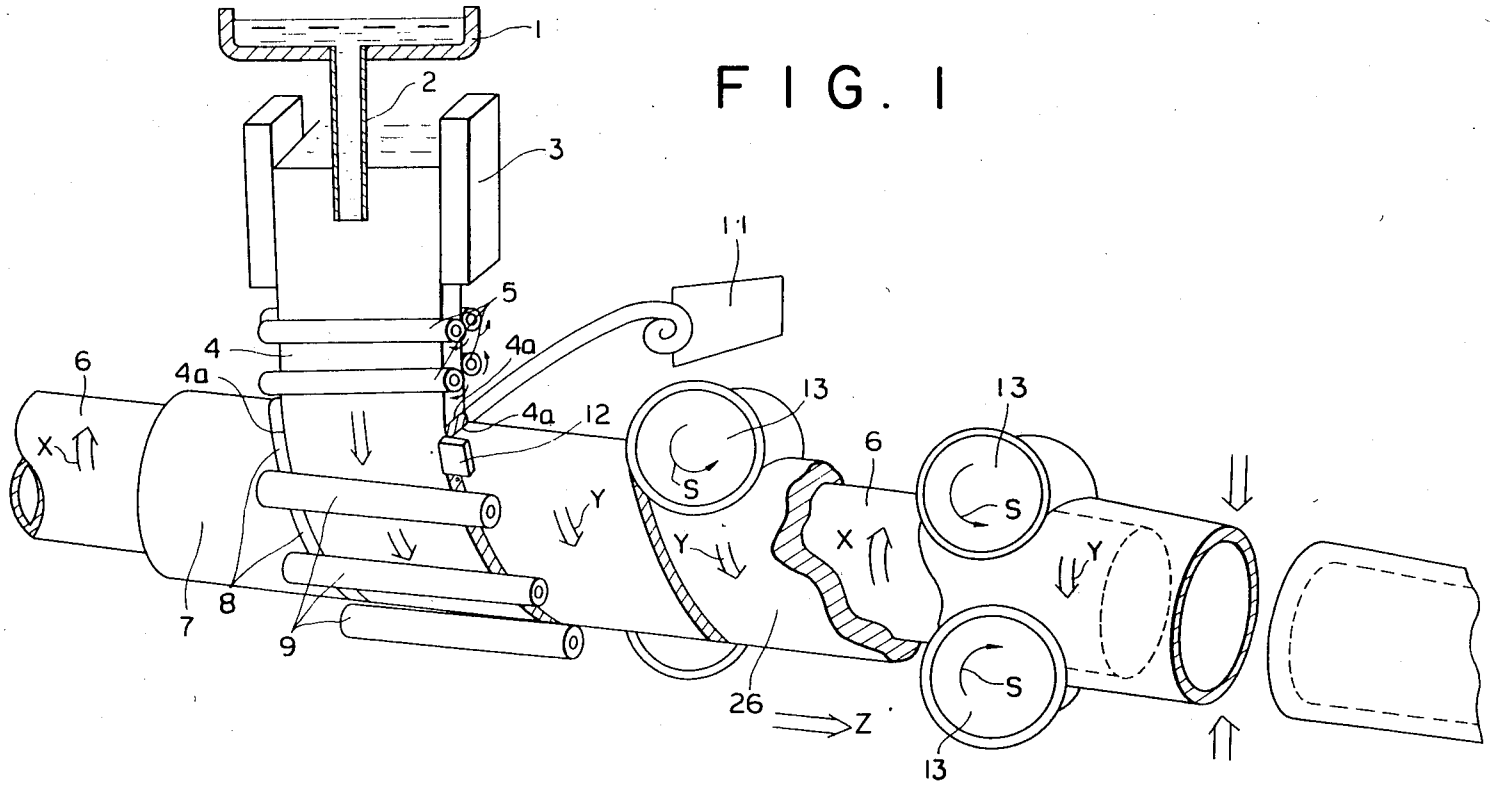
FIG. 1 is a schematic perspective view of manufacturing facilities for practicing a method of manufacturing a cylindrical billet in accordance with the first embodiment of the invention.
Figure 2:
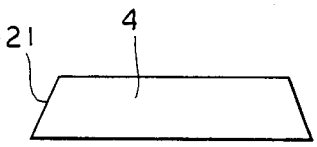
FIG. 2 is a cross-sectional view of a cast slab drawn from the manufacturing facilities in FIG. 1, said cast slab having inclined end faces.

In FIG. 1 reference numeral 1 designates a tundish, reference numeral 2 denotes an immersion type nozzle, reference numeral 3 denotes a casting mold, reference numeral 4 designates a cast slab extending downward from said casting mold 3, reference numeral 5 denotes a plurality of pairs of guide rollers serving to guide said downwardly moving slab 4, reference numeral 6 indicates a mandrel extending in a substantially horizontal direction at a right angle relative to the downwardly moving slab 4, said mandrel 6 being inclinable and rotatable, reference numeral 7 denotes a pusher arranged around the mandrel 6, said pusher 7 being provided with an annular guide face 8 which is inclined relative to the axis of the mandrel 6, reference numeral 9 designates a plurality of guide rollers for spirally winding the cast slab 4 around the mandrel 6 by forcibly thrusting it against the cylindrical surface of the mandrel 6 while it moves downward with its lefthand edge face **4*a* being guided by means of the guide face 8 of the pusher 7, reference numerals 11 and 12 designate an electro-slag welding device for welding the spirally extending end face 4*a* of the cast slab 4 to the adjacent one and reference numeral 13 indicates a plurality of concave drum shaped sizing rollers for reducing the thickness of the spirally welded cast slab, that is, cylindrical billet by thrusting it against the cylindrical surface of the mandrel 6**.

Figure 4:
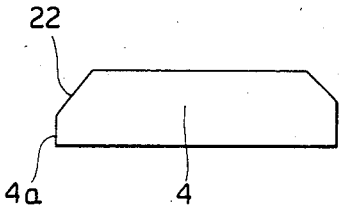
FIG. 4 is a cross-sectional view of a cast slab drawn from the manufacturing facilities in FIG. 1, said cast slab having another type of inclined end faces.
Figure 5:
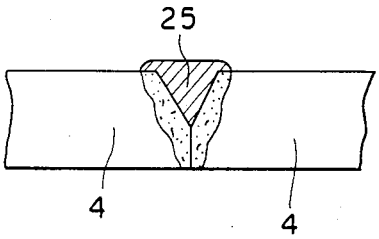
FIG. 5 is a cross-sectional view illustrating how the adjacent inclined end faces of the cast slab in FIG. 4 are welded together with the type of V-shaped welding groove formed therebetween as shown in FIG. 4.

The cross-sectional configuration of the outlet portion of the casting mold 3 is not shown in the accompanying drawing but it is generally configured in such a manner that the cast slab 4 has inclined end faces 21 or 22 as illustrated in FIGS. 4 and 5. Alternatively, the inclined end faces 21 or 22 may be formed by means of the plurality of pairs of guide rollers 5.

Next, description will be made as to how the method in accordance with the first embodiment of the present invention is practiced with the aid of the manufacturing facilities as constructed in the above-described manner.

First, an inclination angle of the mandrel 6 is adjusted so that stress produced during spiral winding of the cast slab 4 and spiral pitch of the latter are properly controlled. Next, the mandrel 6 is caused to rotate in the direction as identified with an arrowed mark in the drawing.

After leaving the casting mold 3, the cast slab 4 with the inclined end faces extending along both the sides thereof is guided downward by means of the plurality of pairs of guide rollers 5. Further, it is spirally wound around the mandrel 6 by one turn while one of the end faces of the cast slab 4 is thrust in the axial direction of the mandrel 6 by means of the guide face 8 of the pusher 7 in such a manner as to cause it to be inclined at a certain inclination angle relative to the axis of the mandrel 6, said inclination angle being determined in accordance with the required spiral pitch, and moreover it is thrusted against the cylindrical surface of the mandrel 6 with the aid of the guide rollers 9. Alternatively, the guide rollers 9 may be arranged so as to wind the cast slab 4 around the mandrel 6 merely by half a turn because of the fact that it moves forward in the axial direction while it is being wound along the mandrel 6 due to its plastic deformation caused by the dead weight thereof. It should be noted that the guide rollers 9 are designed so as to be forcibly rotated for the purposes of guiding, feeding and forming operations.

Figure 3:
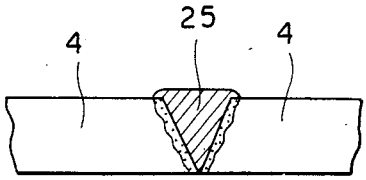
FIG. 3 is a cross-sectional view illustrating how adjacent inclined end faces of the cast slab in FIG. 2 are welded together with a V-shaped welding groove formed therebetween.

On completion of winding of the cast slab 4 around the mandrel 6 by one revolution, electro-slag welding is carried out at the upper end area of the thus formed cylindrical body in order to weld both the inclined end faces 4*a* together, for instance, as illustrated in FIGS. 3 and 5. During the electro-slag welding operation welding material or molten metal to be added to the junction portion is supplied from the same material supply source as that for the cast slab 4 and therefore the completed cylindrical billet has a uniform diameter, thickness and chemical composition throughout the whole length.

As the downwardly moving cast slab 4 is spirally wound around the mandrel 6 with the aid of the plurality of pairs of smaller guide rollers 5 and the larger guide rollers 9 while it is thrusted in the axial direction by means of the pusher 7 so as to cause both the end faces 4*a* of the cast slab 4 to abut against one another to be welded together, the thus cylindrically wound cast slab, that is, cylindrical billet 26 moves forward in the direction as identified with an arrowed mark Z in FIG. 1 while it is rotated in the direction as identified with an arrowed mark Y.

During forward movement of the cylindrical billet 26 the same is subjected to thickness reducing by means of a plurality of sizing rollers 13 adapted to rotate in the direction as identified with an arrow mark S, said sizing rollers 13 being thrust toward the cylindrical surface of the mandrel 6 with the aid of a thrusting mechanism (not shown), whereby the inner structure of the cylindrical billet 26 becomes metallurgically uniform.

Since arrangement is made in the above-described manner such that the mandrel 6 is caused to rotate in the rotational direction X opposite to the rotational direction Y of the cylindrical billet 26, it is assured that rotation of the mandrel 6 is entirely free from forward movement of the cylindrical billet 26 without any fear of causing the occurance of hot sticking therebetween. However, it has been found that drawing of the cast billet 4 from the casting mold 3 is easily effected when the mandrel 6 is caused to rotate in the same direction as the rotational direction Y of the cylindrical billet 26.

When the thus manufactured cylindrical billet 26 is displaced away from the free end of the mandrel 6 by a predetermined distance, it is cut off to have a predetermined length by operating a cutting device (not shown).

Since the cylindrical billet still has a considerably high temperature even after completion of cutting operation, it may be further subjected to rolling work until a final product of steel tube is obtained. As will be readily understood from the above description, any heating process as is required for practicing the conventional method will not be necessary or can be reduced to a minimized extent, resulting in an assured saving of thermal energy. Alternatively, the thus manufactured cylindrical billet may be used as raw material for manufacturing a steel tube in accordance with the conventional method.

The cylindrical billet manufactured by way of the steps as described above has inner and outer surfaces which are very smooth and have a good appearance owing to the fact that the cast slab formed in accordance with the continuous casting process has front and rear surfaces which are very smooth and have a good appearance such that no additional surface processing will be required or such can be minimized.

Further, the inner diameter of the cylindrical billet can be easily changed as required by changing the outer diameter of the mandrel and the outer diameter of the same can be easily changed by changing the thickness of the cast slab. Accordingly, a cylindrical billet having various inner and outer diameters can be manufactured without any particular difficulty.

Since a cylindrical billet is formed by spirally winding a cast slab in the above-described manner, any cylindrical billet having a large inner diameter can be manufactured by using a regularly sized cast slab.

In the above-described embodiment of the invention an electro-slag welding process is employed for joining together the adjacent end faces of a cast slab but the invention should not be limited only to this process such may be replaced with another process such as electro-gas welding, rolling, forging or the like.

It should be of course understood that the method of the invention of manufacturing a cylindrical billet should not be limited only to steel pipe but may be applied to metallic material other than steel, for instance, titanium.

As will be apparent from the above description, the method of maufacturing a cylindrical billet is practiced according to this embodiment of the invention by way of the steps of preparing a cast slab in accordance with the conventional continuous casting process, spirally winding it around a rotating mandrel and joining together the adjacent end faces thereof which are brought in abutment against one another under the influence of a thrusting force with the aid of a plurality of guide rollers and a pusher member so that a required cylindrical billet is formed. Thus, the method in accordance with this embodiment of the invention does not require the steps of blooming, billet heating and piercing, each of which constitutes an essential step for practicing the conventional method, resulting in no occurance of a reduction in yield rate attributable to the steps of blooming and piercing, a remarkably increased operational efficiency and a substantial reduction in expenditures required for installing the manufacturing facilities being assured. Accordingly, cylindrical billets are manufactured inexpensively.

Further, since the method according to this embodiment of the invention is practiced by using a cast slab which has a constant thickness, uniform inner structure and smooth front and rear surfaces, said cast slab being prepared in accordance with the conventional casting process, the thus manufactured cylindrical billet has inner and outer surfaces which are very smooth and have a good appearance with a reduced rate of occurance of irregular thickness and with a highly increased concentricity and dimensional accuracy being assured. Owing to this it is possible to eliminate a part of secondary processing steps, for instance, a step for enlarging the pipe diameter and therefore subsequent pipe processing steps are easily carried out for the cylindrical billet.

Further, since the method according to this embodiment of the invention makes it possible to easily manufacture a cylindrical billet having any combination of thickness and diameter ranging from a combination of thinner thickness and small diameter to a combination of heavier thickness and larger diameter merely by changing the outer diameter of the mandrel and the thickness of the cast slab, it is preferably applicable either to a case where a small number and many types of cylindrical billets are manufactured or to a case where a large number and few types of cylindrical billets are manufactured.

Further, since the method according to this embodiment of the invention is practiced by using a cast slab prepared in accordance with the conventional continuous casting process to manufacture cylindrical billets, manufacturing is continuously carried out throughout the whole process from the beginning step of steel making to the final step of joining together the adjacent end faces of the spirally wound slab. Moreover, when subsequent pipe processing steps are required, they are carried out without any intermittence while a reduced amount of thermal energy is consumed for reheating cylindrical billets.

Next, a description will be set forth as to a method of manufacturing a cylindrical billet in accordance with the second embodiment of the invention with reference to FIGS. 6 to 11.

Figure 7:
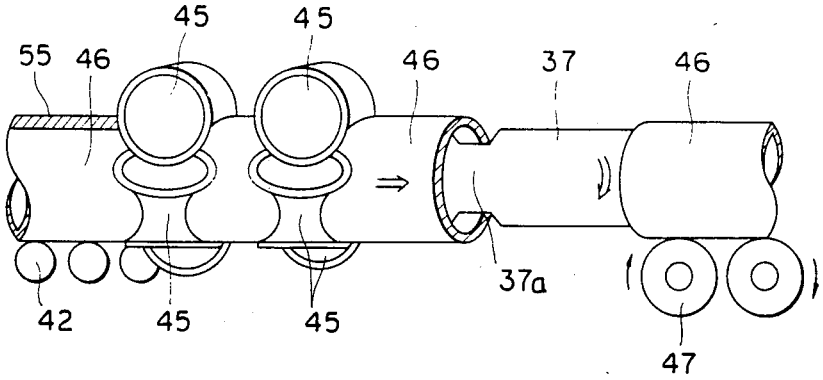
FIG. 7 is a schematic perspective view of the rear portion of the manufacturing facilities in FIG. 6.
Figure 6:
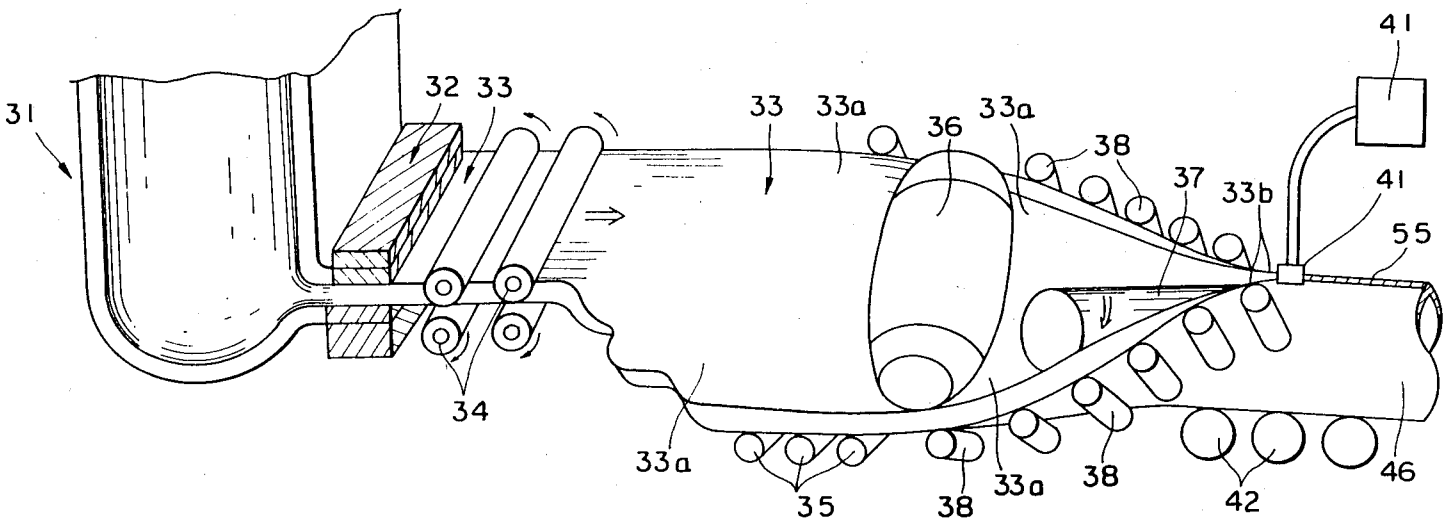
FIG. 6 is a schematic perspective view of manufacturing facilities for practicing a method of manufacturing a cylindrical billet in accordance with the second embodiment of the invention.

More particularly, FIG. 6 schematically illustrates a conventional horizontal type continuous casting stand by way of a partially broken perspective view. In FIG. 6 reference numeral 31 designates a casting mold, reference numeral 32 denotes an outlet portion of said casting mold 31, reference numeral 33 indicates a cast slab horizontally moving away from said outlet portion 32, reference numeral 34 designates a plurality of pairs of guide rollers arranged parallel to one another at a right angle relative to the axis of movement of the cast slab 33, one group of said guide rollers 34 being located above the cast slab 33 and another group of the same being located below the latter, reference numeral 35 denotes a plurality of holding rollers located below the cast slab 33 which has passed through the groups of guide rollers 14, reference numeral 36 indicates a covex drum shaped sizing roller located above the cast slab 33 which has passed above the holding rollers 35, reference numeral 37 indicates a rotatable mandrel extending in the direction of movement of the cast slab 33 which has passsed below the sizing roller 36, reference numeral 38 denotes a group of guide rollers arranged in spaced relation along both the side parts 33*a* of the cast slab 33 to thrust the latter toward the mandrel 37 in such a manner as to encase the mandred 37 with the cast slab 33 until both end faces 33*b* of the side parts 33*a* are brought into abutment against one another, reference numeral 41 denotes an electro-slag welding apparatus for welding together both end faces 33*b* and reference numeral 42 indicates a plurality of conveyance rollers. In FIG. 7 reference numeral 45 designates a plurality of groups of concave drum shaped sizing rollers arranged around the cylindrically formed cast slab 46, that is, cylindrical billet 46 which has passed by the electro-slag welding apparatus 41 after completion of welding operation, each of said groups comprising four sizing rollers which are located along the periphery of the mandrel 37 with an angular distance of 90 degrees being maintained between the adjacent rollers, and reference numeral 47 denotes a plurality of conveyance rollers for conveying a cylindrical billet 46 after it has been cut to a predetermined length.

Figure 8:
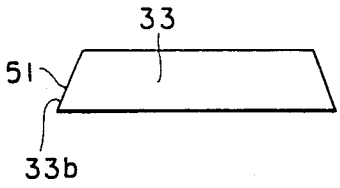
FIG. 8 is a cross-sectional view of a cast slab drawn from the manufacturing facilities in FIGS. 6 and 7, said cast slab having inclined end faces.
Figure 9:
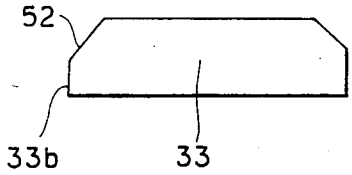
FIG. 9 is a cross-sectional view of a cast slab drawn from the manufacturing facilities in FIGS. 6 and 7, said cast slab having an additional type of inclined end faces.

The cross-sectional configuration of the outer portion 32 of the casting mold 31 is not shown in the accompanying drawing but it is generally configured in such a manner that the cast slab 33 has inclined end faces 33*b* as illustrated in FIGS. 8 and 9 to form a V-shaped welding groove 51 or 52 between the adjacent ones. Alternatively, the V-shaped welding groove 51 or 52 may be formed by means of the plurality of pairs of guide rollers 34.

Next, a description will be set forth as to how the method in accordance with the second embodiment of the invention is practiced with the aid of the manufacturing facilities as constructed in the above-described manner.

First, the cast slab 33 is drawn from the outlet portion 32 of the casting mold 31 in the horizontal direction while it is guided by means of the plurality of pairs of guide rollers 34. After it has passed through the guide rollers 34, it is caused to expand to the illustrated increased width under the influence of a rolling operation carried out by means of a depressing roller (not shown) in cooperation with the holding rollers 35.

Both the side parts 33*a* of the rolled cast slab 33 are then thrust toward the convex drum shaped sizing roller 36 by means of the guide rollers 38 and are further gradually brought in contact with the periphery of the mandrel 37 with the aid of the guide rollers 38 as if the mandril 37 is encased with the cast slab 33 until the latter is wound about the mandrel 37. As a result the adjacent end faces 33*b* of the side parts 33*a* come in contact with one another with a V-shaped welding groove formed therebetween.

Figure 10:
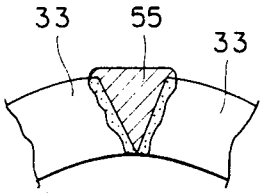
FIG. 10 is a cross-sectional view illustrating how the adjacent inclined end faces of the cast slab in FIG. 8 are welded together with a V-shaped welding groove formed therebetween.
Figure 11:
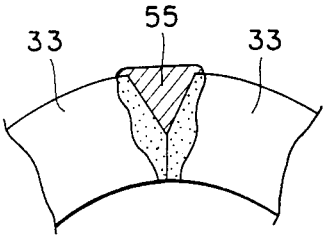
FIG. 11 is a cross-sectional view illustrating how the adjacent inclined end faces of the cast slab in FIG. 9 are welded together with yet another type of V-shaped welding groove formed therebetween.

As a next step both the end faces 33*b* of the side parts 33*a* are welded together with the V-shaped welding grooves 51 filled with molten metal as illustrated in FIGS. 10 and 11 with the aid of the electro-slag welding apparatus 51 whereby a required cylindrical billet 46 is formed. As is apparent from FIG. 6, the welded seam 55 extends linearly as the cast slab 55 moves forward. In other words the cylindrical billet 46 is obtained in the form of a seam welded pipe. It should be noted that welding material or molten metal to be added into the V-shaped welding groove during welding operation is supplied from the same material supply source as that of the cast slab 33 and thereby the cylindrical billet 46 has a uniform inner structure throughout the entire length thereof.

The thus manufactured cylindrical billet 46 is conveyed in the rightward direction as seen in the drawing by means of the conveyance rollers 42 so that it is subjected to thickness reduction under the influence of rolling force imparted by the group of concave drum shaped sizing rollers 45 each of which is rotating while moving forward, said rolling force being exerted on the cylindrical surface of the cylindrical billet 46 in four radial directions. After completion of reducing operation the inner structure of the cylindrical billet 46 becomes metallurgically uniform in nature.

Since the mandrel 37 is caused to rotate during the above-mentioned forming steps, there is no fear of causing the mandrel 37 to be stuck to the cylindrical billet 46.

Finally, the cylindrical mandrel 46 is cut to a predetermined length at the throat portion 37*a* of the mandrel 37 by operating a cutting device (not shown). As a result a required cylindrical billet having a predetermined length is obtained.

As is apparent from the above description, this embodiment is different from the foregoing one merely with respect to the fact that a cast slab is drawn in the horizontal direction in accordance with the conventional horizontal type continuous casting process but both the embodiments are identical to one another with respect of the fact that the cast slab is wound around the mandrel with both side parts being brought into abutment against one another as if the mandrel is wrapped with the cast slab and they are then joined together by welding operation so that a cylindrical billet is produced in the form of a seam type pipe. Thus, the same inventive effects as those in the foregoing embodiment are obtainable. Accordingly, the method in accordance with this embodiment does not require the steps of blooming, billet heating and piercing, each of which constitutes an essential step for practicing the conventional method, resulting in assurance of a substantial saving of material and thermal energy, a remarkably improved operational efficiency and a reduced expenditure required for installing the manufacturing facilities. Thus, a required cylindrical billet is manufactured at a substantially reduced manufacturing cost.

Next, a description will be set forth as to a method of manufacturing a cylindrical billet in accordance with the third embodiment of the invention with reference to FIGS. 12 to 18.

Figure 13:
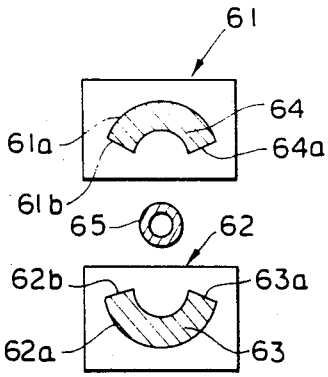
FIG. 13 is a cross-sectional view of the manufacturing facilities taken along line XIII—XIII in FIG. 12.
Figure 14:
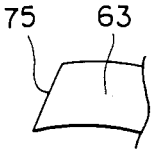
FIG. 14 is a fragmental cross-sectional view of a cast slab drawn from the manufacturing facilities in FIG. 12, said cast slab having inclined end faces.
Figure 12:
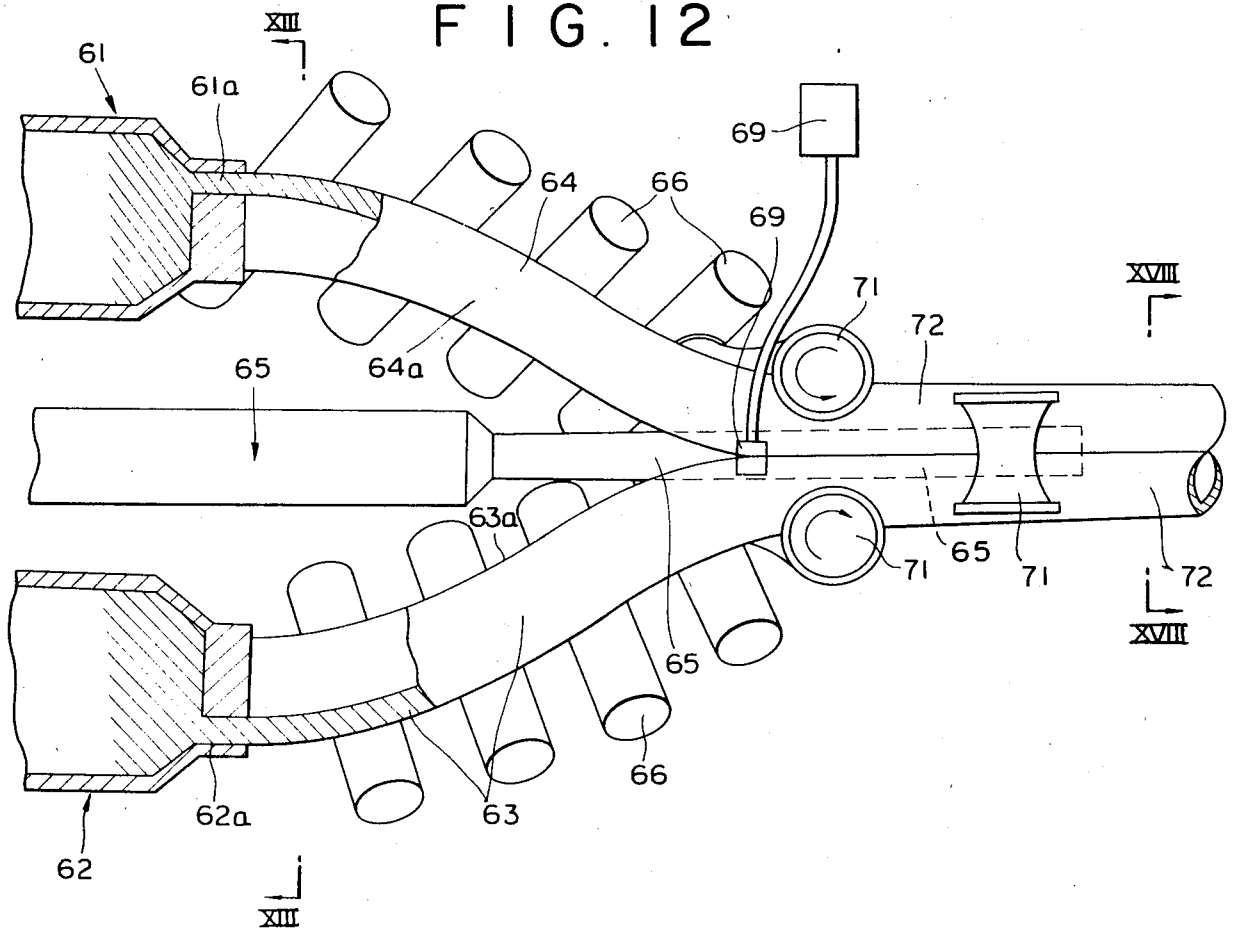
FIG. 12 is a schematic partially sectioned plan view of manufacturing facilities for practicing a method of manufacturing a cylindrical billet in accordance with the third embodiment of the invention.

In FIG. 12 in which two sets of conventional horizontal type continuous casting stands are schematically illustrated, reference numerals 61 and 62 designate first and second casting molds disposed in a spaced relation with a certain distance being maintained therebetween, said casting molds 61 and 62 being formed with openings 61*a* and 62*a* having a semi-circular cross-sectional configuration as illustrated in FIG. 13, reference numerals 63 and 64 denoting cast slabs horizontally drawn from the first and second casting molds 61 and 62, each of said cast slabs 63 and 64 having a semi-circular cross-sectional configuration, reference numeral 65 indicating a rotatable mandrel extending in the longitudinal direction of the manufacturing facilities between both the first and second casting molds 61 and 62, reference numeral 66 denoting two groups of guide rollers for gradually thrusting the cast slabs 63 and 64 toward the mandrel 65 until the end faces 63*a* of the cast slab 63 come in contact with the associated end faces 64*a* of the cast slab 64, reference numeral 69 denoting an electro-slag welding apparatus for welding together both end faces 63*a* and 64*a* of the cast slabs 64 and 64 and reference numeral 71 indicating a plurality of pairs of concave drum shaped sizing rollers arranged in spaced relation in the axial direction to reduce the thickness of the thus formed cylindrical billet 72 in cooperation with the mandrel 65 under the influence of a rolling force imparted thereby, the direction of the axis of each pair of said sizing rollers 71 being deviated from that of the adjacent pair by 90 degrees.

Figure 16:
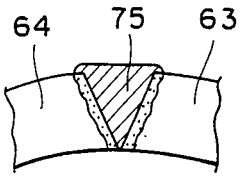
FIG. 16 is a cross-sectional view illustrating how the adjacent inclined end faces of the cast slab in FIG. 14 are welded together with a V-shaped welding groove formed therebetween.
Figure 17:
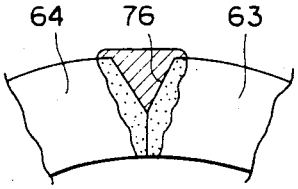
FIG. 17 is a cross-sectional view illustrating how the adjacent inclined end faces of the cast slab in FIG. 15 are welded together with the type of V-shaped welding groove formed therebetween shown in FIG. 15.
Figure 18:
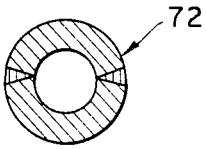
FIG. 18 is a cross-sectional view of a cylindrical billet produced by the manufacturing facilities, taken along line XVIII—XVIII in FIG. 12.

Both the end wall parts 61*b* and 62*b* of the openings 61*a* and 62*a* of the first and second casting molds 61 and 62 are inclined relative to the bottom of the casting molds so as to form a V-shaped welding groove 75 between both the end faces of the cast slabs 63 and 64 illustrated in FIG. 16. Alternatively, both end wall parts 61*b* and 62*b* of the openings 61*a* and 62*a* may be inclined so as to form another type of V-shaped welding groove 76 as illustrated in FIG. 17.

Next, a description will be provided as to how the method in accordance with the third embodiment of the invention is practiced with the aid of the manufacturing facilities as constructed in the above-described manner.

First, a pair of semi-circular cast slabs 63 and 64 with the end faces thereof being inclined are drawn from a pair of casting molds 61 and 62 in the horizontal direction and are then thrust gradually toward the rotating mandrel 65 by means of the group of guide rollers 66 until both end faces 63*a* and 64*a* of the cast slabs 63 and 64 come into abutment with one another while they are conveyed forward.

Figure 15:
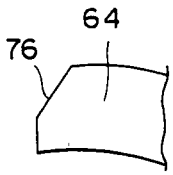
FIG. 15 is a fragmental cross-sectional view of a cast slab drawn from the manufacturing facilities in FIG. 12, said cast slab having another type of inclined end faces.

Next, the end face 63*a* of the cast slab 63 is welded with the end face 64*a* of the cast slab 64 with the aid of the electro-slag welding apparatus 69 as illustrated in FIG. 16 and thereby a cylindrically formed cast slab, that is, cylindrical billet 72 is produced. Since the welding material or molten metal to be added to the V-shaped welding groove during welding operation is supplied from the same material supply source as that for the cast slabs 63 and 64, it is assured that the cylindrical billet 72 has an uniform inner structure. When the cast slab has an inclined face as illustrated in FIG. 15, welding is effected in the cross-sectional form as illustrated in FIG. 17.

Next, the cylindrical billet 72 is subjected to thickness reduction by thrusting it against the mandrel 65 by means of the plurality of pairs of sizing rollers 71 under the influence of a rolling force imparted thereby while the cylindrical billet 72 is conveyed and the sizing rollers 71 are rotated. On completion of thickness reduction the cylindrical billet 72 has a metallurgically uniform inner structure.

Since the mandrel 65 is caused to rotate during the forming step for the cylindrical billet 72, there is no fear of causing the mandrel 65 to be stuck to the cylindrical billet 72.

When the cylindrical billet 72 is displaced away from the free end of the mandrel 65 by a certain distance, it is cut to a predetermined length by operating a cutting device (not shown). Thus, a required cylindrical billet having the predetermined length is obtained.

Since the method in accordance with this embodiment is practiced by using a plurality of arched cast slabs which are horizontally drawn from a plurality of casting molds in accordance with the conventional horizontal type continuous casting process, the cross-sectional configuration of said cast billets is constituted by a part of the annular cross-sectional configuration of the cylindrical billet which is equal to a fragment obtained by dividing it by the number of cast slabs such is identical to the foregoing embodiments in respect to the fact that the cast slabs are welded together in a side-to-side relation while they are cylindrically bent around the rotating mandrel by means of the guide rollers and therefore the same inventive effects as those in the foregoing embodiments are obtainable. Accordingly, the method in accordance with this embodiment does not require the steps of blooming, billet heating and piercing, each of which constitutes an essential step for practicing the conventional method, resulting in substantial saving of material and thermal energy and assuring a remarkably increased working efficiency and reduced expenditure required for installing the manufacturing facilities. Accordingly, cylindrical billets are manufactured inexpensively.

In the above-mentioned embodiment a cylindrical billet is produced by welding together two cast slabs each of which has a semi-cylindrical cross-sectional configuration obtained by cutting a cylinder into two halves along a plane extending through the axis of the cylinder, but the invention should not be limited to this feature. Alternatively, the method may be practiced by using more than 2 cast slabs, for instance, 3 to 5 cast slabs and welding them together in side-to-side relation, each of said cast slabs constituting a longitudinally extending fragment of the cylindrical billet.

Figure 19:
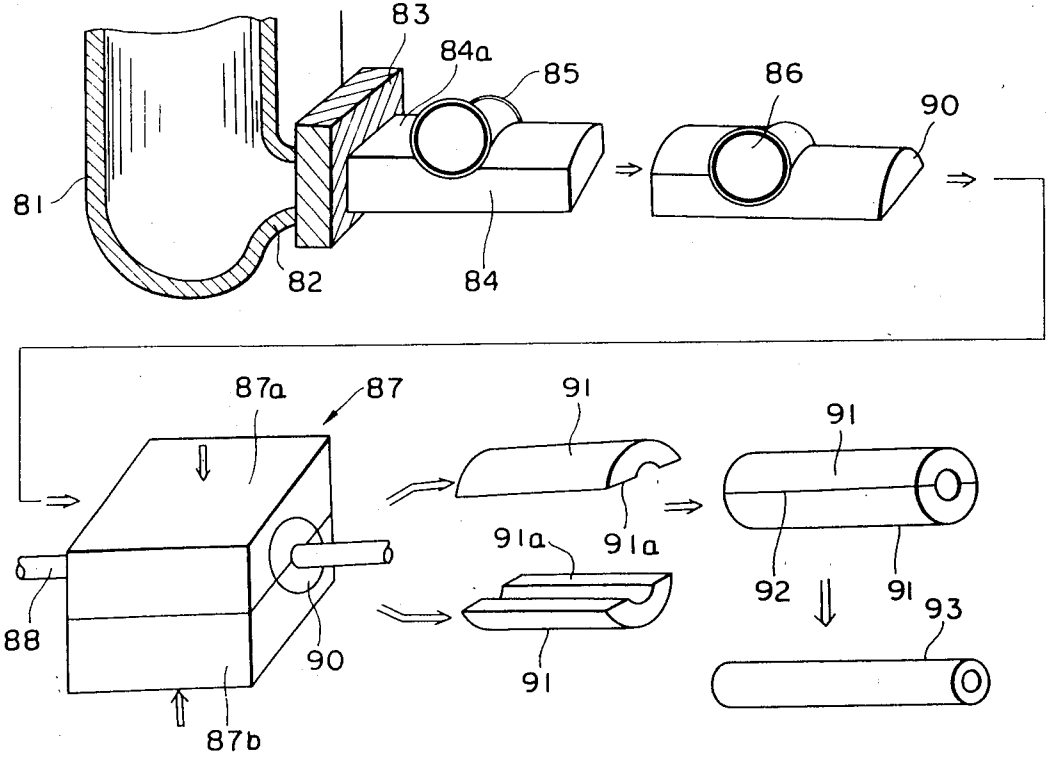
FIG. 19 is a schematic perspective view of manufacturing facilities for practicing a method of manufacturing a cylindrical billet in accordance with the fourth embodiment of the invention.

Next, a description will be provided as to a method of manufacturing a cylindrical billet in accordance with the fourth embodiment of the invention with reference to FIG. 19.

In FIG. 19 in which a conventional horizontal type continuous casting stand is schematically illustrated by way of a perspective view wherein reference numeral 81 designates a tundish, reference numeral 82 denotes an immersion type nozzle, reference numeral 83 is a casting mold, reference numeral 84 is a flat cast slab horizontally drawn from said casting mold 83, reference numeral 85 indicates a first concave drum shaped roll disposed above said cast slab 84 at the position located in the vicinity of said casting mold 83, reference numeral 86 is a second concave drum shaped roll disposed above the cast slab 84 at the position located downstream of said first roll 85, reference numeral 87 is a press work device including an upper die half 87*a* and a lower die half 87*b* and reference numeral 88 indicates a mandrel in the from of a rod extending through the central part of said press working device 87.

Specifically, the first roll 85 is located at the position where the cast slab 84 is subjected to plastic deformation against small resistance after leaving the casting mold 83 and rolling operation is carried out by depressing the first roll 85 having a concave rolling surface on the upper surface 84*a* of the cast slab 84 so that the latter is rolled down to the arched configuration corresponding to the concave rolling surface of the first roller 85. The second roller 86 is intended to additionally roll down the upper arched surface 84*a* of the cast slab 84 which has been subjected to rolling operation at the first roller 85 to the semi-circular cross-sectional configuration as illustrated at the right end part of FIG. 19. It should be noted that a plurality of conventional guide rollers (not shown) are arranged below the cast slab 84 at the position located opposite both the first and second rolls 85 and 86 so as to inhibit occurance of bending of the cast slab 84.

When the cast slab 84 having the semi-circular cross-sectional configuration is displaced away from the second roll 86 by a certain distance, it is cut to a predetermined length by operating a cutting device (not shown). Thus, cast slabs 90 having a semi-circular cross-sectional configuration are successively produced in this manner. Next, two cast slabs 90 having the semi-circular cross-sectional configuration and cut to the predetermined length are transferred to the cavity having the semi-circular cross-sectional configuration corresponding to that of the cast slab 90 in the upper and lower die halves 87*a* and 87*b* of the press working device 87 and thereafter the upper die half 87*a* is superimposed on the lower die half 87*b* in such a manner that the bottom 90*a* of the one cast slab 90 is located opposite to that of the other cast slab 90 and thereby a cylindrical configuration is formed by two cast slabs. At this moment the cast slabs 90 laid on the cavities in the press work device 87 are maintained hot and therefore an axially extending recess having a semi-circular cross sectional configuration is easily formed on the bottom 90 of each of the cast slabs 90 by the steps of disposing a mandrel 88 between both the cast slabs 90 along the center axis of the latter and depressing the upper die half 87*a* with the aid of a pressing machine (not shown). After completion of press working the mandrel 88 is removed from the press work device 87 and the latter is then disassembled. Thus, two arched cast slabs 91 are obtained each of which is formed with an axially extending recess having a semi-circular cross-sectional configuration along the center axis thereof. Next, one arched cast slab 91 is superimposed on the other one in such a manner their bottom surfaces 91*a* are located opposite one another and joining operation is carried out along the contact line 92 extending between both the arched cast slabs 91. Forging, rolling or welding is employed for jointing operation. As a result a cylindrical body, that is, cylindrical billet 93 as illustrated in the drawing, is obtained. Metallic material or molten metal to be added to the joined area should be supplied from the same material source as that for the original cast slabs. In other words, the metallic material to be added should be the same material as that of the original cast slabs.

Since the cylindrical billet 93 still has a considerably high temperature, a required seamless pipe 94 can be easily made from the cylindrical billet 93 by employing thickness reduction rolling, extracting, drawing or similar process without the necessity of reheating or like steps.

In the above-mentioned embodiment cylindrical billets are manufactured with the aid of a conventional horizontal type continuous casting stand but the present invention is limited only to this. Alternatively, a vertical type continuous casting stand may be employed for manufacturing cylindrical billets.

Since the method in accordance with this embodiment is practiced by way of the steps of roll forming a cast slab drawn from a casting mold to the semi-circular configuration at a time when it has little resistance against deformation, placing one cast slab having a semi-circular cross-sectional configuration on the bottom of the other cast slab having a semi-circular cross-sectional configuration in such a manner as to form a circular cross-sectional configuration with a mandrel interposed therebetween along the center axis, press working the superimposed assembly of two cast slabs to form two arched cast slabs with a recess having a semi-circular cross-sectional configuration extending along the center axis and finally joining together the superimposed assembly of two arched cast slabs by carrying out joining operation along the contact line extending therebetween so that a cylindrical billet is produced, there is no necessity of practicing the steps of blooming, billet heating and pierciing, each of which constitutes an essential process part for the conventional method, resulting in a guaranteed substantial reduction in installation of manufacturing facilities and consumption of thermal energy. Thus, cylindrical billets can be manufactured inexpensively.

It has been found with respect to the conventional method that a substantial reduction in the yield rate is caused during the steps of blooming and piercing. On the other hand, there occurs no reduction in yield rate when the method in accordance with this embodiment is employed. As a result a remarkably improved yielding rate and inexpensive manufacturing are achieved.

Since a cylindrical billet manufactured in accordance with this embodiment of the invention has inner and outer surfaces which are very smooth and exhibit a good appearance owing to the fact that a cast slab prepared by the conventional continuous casting process has front and rear surfaces which are very smooth and exhibit a good appearance, no secondary processing is required or such can be minimized.

Further, the method of the invention makes it possible to easily produce a cylindrical billet having various dimensions ranging from a combination of thinner thickness and smaller diameter to a combination of greater thickness and larger diameter merely by changing the thickness of the cast slab, the configuration of roll, the dimensions of press work device and the outer diameter of mandrel. In particular, it is possible to manufacture a cylindrical billet having any special size which could not be processed by the conventional method.

Since the method of the invention includes the steps of roll forming a cast slab having a constant thickness to the semi-circular configuration at a time when little resistance against deformation occurs, forming on each of the roll formed cast slabs an axially extending recess having a semi-circular cross-sectional configuration with the aid of a mandrel and a press working device and joining together two arched cast slabs superimposed in the form of a cylinder so that a cylindrical billet is produced, it is assured that manufacturing is carried out with a reduced rate of occurance of irregular thickness. In addition, an improved inner structure, particularly with a reduced occurance of anisotropy and a highly increased concentricity and dimensional accuracy is possible. Moreover the subsequent steps of manufacturing a pipe are easily practiced with a part of conventional processing steps eliminated therefrom because a seamless pipe can be made from the cylindrical billets without any necessity of reheating or a similar step.

Manufacturing facilities are also structurally very simple and require only a small space so that they can be equipped with accessories and instruments in a compact manner.

The method of the invention should not be limited only to manufacturing of steel pipes but may be successfully applied to a case where pipes are made from metallic material other than steel, for instance, titanium.

As will be readily understood from the above description, the characterizing features of the method of the invention are that a large part of the conventional processing steps can be neglected, seamless steel pipes having various combinations of wall thickness and diameter are manufactured inexpensively and the method is effectively applicable either to a case where a small number and many types of pipes are manufactured or to a case where a large number and small types of pipes are manufactured.

Figure 21:
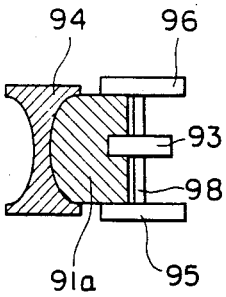
FIG. 21 is a cross-sectional view of a cast slab which is roll formed with the aid of a concave drum shaped forming roller and a grooving roller.
Figure 20:
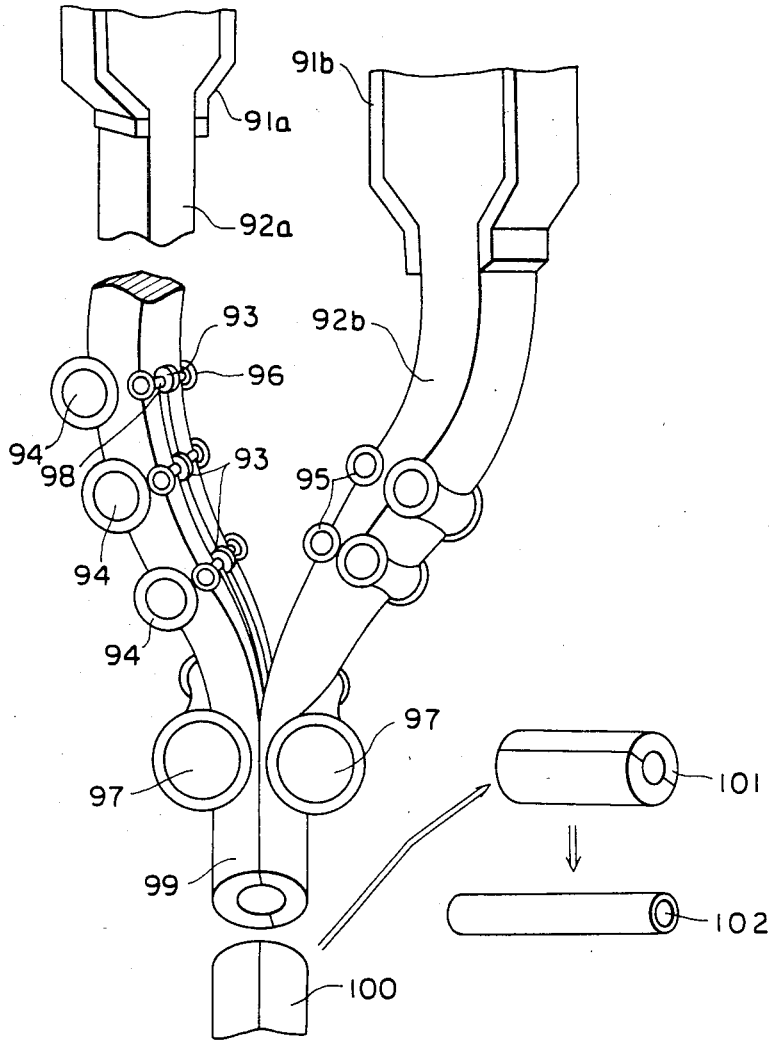
FIG. 20 is a schematic perspective view of manufacturing facilities for practicing a method of manufacturing a cylindrical billet in accordance with the fifth embodiment of the invention.

Finally, a description will be set forth as to a method of manufacturing a cylindrical billet in accordance with the fifth embodiment of the invention with reference to FIGS. 20 and 21.

In FIG. 20 in which a conventional vertical type continuous casting stand is schematically illustrated by way of a perspective view, reference numerals 101*a* and 101*b* designate a pair of casting molds disposed in a spaced relation with a certain distance maintained therebetween and reference numerals 92*a*, also, and 92*b* denote a solid cast slab having a square cross-sectional configuration, respectively, which is drawn from said casting molds 91*a* and 91*b* in the downward direction. Both the cast slabs 92*a* and 92*b* are guided by means of a plurality of guide rollers (not shown) disposed below the casting molds 91*a* and 91*b* in such a maner that they come close to one another. While the cast billets 92*a* and 92*b* are guided by means of the aforesaid guide rollers, they are cooled down to a certain extend by operating a cooling device (not shown) so that any unsolidified part of molten metal disappears. Further, a plurality of grooving rollers 93 are disposed in a spaced relation along the center line of the inside surface of both the cast slabs 92*a* and 92*b* at the position where very few resistance appears against deformation and thereby plastic deformation is readily carried out, whereas a plurality of concave drum shaped forming rollers 94 are disposed in a spaced relation along the outside surface of both the cast slabs 92*a* and 92*b* at the position located opposite to the grooving rollers 93 for the purpose of roll forming the cast slabs 92*a* and 92*b* to the semi-cricular cross-sectional configuration. Thus, the cast slabs 92*a* and 92*b* to be roll formed are sandwiched between the grooving rollers 93 and the forming rollers 94. As is apparent from the drawings, each of the grooving rollers 93 includes a support shaft 98 and a pair of width defining rollers 95 and 96 fixedly secured to both ends of said support shaft 98 so that the grooving roller 93 is fixedly mounted on the support shaft 98 at its central position to rotate together with the width defining rollers 95 and 96. Each of the grooving rollers 93 is located at a right angle relative to the inside surface of the cast slabs 92*a* and 92*b* to be roll formed so that a longitudinally extending groove 98 is roll formed thereby while the cast slabs 92*a* and 92*b* move downward and the grooving roller 93 are rotated under the influence of thrusting force toward the inside surface of the case slabs 92*a* and 92*b*. During the roll forming step the pair of width defining rollers 95 and 96 are rotated by both side surfaces of the cast slab in order to inhibit lateral expansion of the cast slab and maintain its width constant. On the other hand, the forming rollers 94 located opposite the associated grooving rollers 93 with the cast slab interposed therebetween are thrust toward the outside surface of the cast slab so that it is gradually roll formed to the semi-circular cross-sectional configuration. On completion of roll forming the cast slabs 92*a* and 92*b* assume a semi-cylindrical configuration and when they pass through a pair of uniting rollers 97 they become semi-cylindrical billets 99. It should be noted that the plurality of groups of rollers 93, 94, 95 and 96 are disposed with a certain distance maintained between the adjacent rollers in the direction of movement of the cast slabs 92*a* and 92*b* in such a manner they assume a substantially semi-cylindrical configuration before their bottom surfaces come in contact with one another. Further, it should be noted that the grooving rollers 93 are so designed that their width becomes wider and their peripheral configuration becomes more semi-circular the lower their location.

A pair of concave drum-shaped uniting rollers 97 having a larger diameter are disposed at the position where both the semi-cylindrical billets 99 come in contact with one another so that their bottom surfaces are joined together under the influence of a thrusting force imparted by said pair of uniting rollers 97 to form a cylindrical billet. After the joined semi-cylindrical billets 99 pass through the pair of uniting rollers 97, a required cylindrical billet 100 is obtained. Both the semi-cylindrical billets 99 are preferably joined by welding, forging or the like process. When they are jointed together by welding operation, the metallic material or molten metal to be added should be supplied from the same material supply source as that for the original cast slabs.

When the cylindrical billet 100 is displaced downwardly of the pair of uniting rollers 97 at a predetermined distance away from the latter, such is cut to a predetermined length by operating a cutting device (not shown) whereby a cylindrical billet 101 having the predetermined length is obtained. Since the thus produced cylindrical billet 101 still has a considerably high temperature, it is subjected to subsequent working such as thickness reduction rolling, drawing, extruding or the like without any necessity for reheating whereby a seamless steel pipe 102 is produced.

This embodiment is different from the foregoing ones with respect to the step of forming a longitudinally extending recess having a semi-circular cross-sectional configuration but the former is identical to the latter in respect of the fact that a cast slab is deformed to the semi-circular configuration with the aid of a plurality of forming rollers at a time when it has only slight resistance against geometrical deformation. Accordingly, substantially the same inventive effects as those in the foregoing embodiment are also assured with respect to this embodiment.

Although the present invention has been fully described above by way of several preferred embodiments with reference to the accompanying drawings, it should be of course understood that the invention should not be limited only to such embodiments and that various changes or modifications may be made in a suitable manner without any departure from the spirit and scope of the invention as defined in appended claims. Since such changes or modifications do not depart from the scope of the invention, they should be construed as included therein.

What is claimed is:

1. A method of manufacturing a cylindrical billet utilizing a mandrel and a plurality of guide rollers, which comprises:

drawing a cast slab from a casting mold on a continuous casting stand while simultaneously deforming the cast slab around the periphery of said mandrel with the aid of said plurality of guide rollers;

joining together both end faces of the cast slab;

pressing the cast slab against said mandrel so as to reduce the thickness of the cast slab so as to form a cylindrical body of substantially uniform thickness and diameter; and cutting the thus formed cylindrical body to a predetermined length upon displacement thereof away from the mandrel a certain distance.

2. A method manufacturing a cylindrical billet as defined in claim 1, utilizing a pusher member having a guide face inclined by a certain angle relative to an axis of the mandrel wherein said deforming of the cast slab further comprises spirally winding said cast slab around the mandrel while thrusting said cast slab toward said mandrel by means of said guide rollers, axially thrusting a first end face of the spirally wound cast slab by means of said pusher member so as to assure that the adjacent end faces of the cast slab come into contact with one another; and wherein said joining together end faces of the cast slab further comprises spirally joining together adjacent end faces of the cast slab in the form of a seam pipe.

3. A method of manufacturing a cylindrical billet as defined in claim 1, which further comprises;

rolling the cast slab to enlarge it in width in the lateral direction and thereby flatten the cast slab and wherein said deforming of the cast slab further comprises cylindrically bending both side parts of the flattened cast slab around the mandrel so as to encase the mandrel with the cast slab in such a manner that a contact line between both end faces of the cylindrically bent cast slab extends in the direction of movement of the latter and linearly joins together adjacent end faces of the cast slab in the form of a seam pipe.

4. A method of manufacturing a cylindrical billet as defined in any one of claims 1 to 3, which further comprises rotating the mandrel in the cylindrical body formed by the deformed cast slab.

5. A method of manufacturing a cylindrical billet as defined in any one of claims 1 to 3, wherein said joining of the adjacent end faces of the cast slab further comprises welding adjacent end faces to the cast slab.

6. A method of manufacturing a cylindrical billet as defined in any one of claims 1 to 3, which further comprises supplying a material to be welded to the adjacent end faces of the cast slab from a same material source as that for the cast slab.

7. A method of manufacturing a cylindrical billet as defined in any one of claims 1 to 3, which further comprises inclining each end face of the case slab by a certain angle so as to form a V-shaped welding groove.

8. A method of manufacturing a cylindrical billet as defined in claim 7, which further comprises defining the inclined end faces of the cast slab by a cross-sectional configuration of the outlet portion of the casting mold.

9. A method of manufacturing a cylindrical billet as defined in claim 7, which further comprises forming the inclined end faces of the cast slab by means of the guide rollers during movement of the cast slab away from the casting mold.

* * * * *